US009911387B2

(12) United States Patent
Kim et al.

(10) Patent No.: US 9,911,387 B2
(45) Date of Patent: Mar. 6, 2018

(54) DISPLAY APPARATUS FOR ADJUSTING BACKLIGHT LUMINANCE BASED ON COLOR GAMUT BOUNDARY AND DRIVING METHOD THEREOF

(71) Applicant: SAMSUNG DISPLAY CO., LTD., Yongin Si, Gyeonggi-Do (KR)

(72) Inventors: Heendol Kim, Yongin-si (KR); Jai-hyun Koh, Hwaseong-si (KR); Hyunkyu Namkung, Cheonan-si (KR); Seokyun Son, Suwon-si (KR); Kuk-hwan Ahn, Hwaseong-si (KR); Iksoo Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 80 days.

(21) Appl. No.: 14/992,944

(22) Filed: Jan. 11, 2016

(65) Prior Publication Data

US 2016/0247460 A1 Aug. 25, 2016

(30) Foreign Application Priority Data

Feb. 23, 2015 (KR) ..... 10-2015-0025355

(51) Int. Cl.
*G09G 3/36* (2006.01)
*G09G 3/34* (2006.01)

(52) U.S. Cl.
CPC ..... *G09G 3/3413* (2013.01); *G09G 3/3607* (2013.01); *G09G 3/3611* (2013.01); *G09G 2300/0452* (2013.01); *G09G 2320/0242* (2013.01); *G09G 2320/0646* (2013.01); *G09G 2320/0666* (2013.01); *G09G 2340/06* (2013.01); *G09G 2360/16* (2013.01)

(58) Field of Classification Search
CPC ..... G09G 3/3413
USPC ..... 345/102, 694
See application file for complete search history.

(56) References Cited

U.S. PATENT DOCUMENTS

| | | | | |
|---|---|---|---|---|
| 8,139,021 | B2 | 3/2012 | Botzas et al. | |
| 8,184,089 | B2 | 5/2012 | Botzas et al. | |
| 8,223,180 | B2 | 7/2012 | Elliott et al. | |
| 8,432,337 | B2 | 4/2013 | You et al. | |
| 2010/0283801 | A1* | 11/2010 | Wu | G09G 3/2003 345/690 |
| 2011/0025592 | A1* | 2/2011 | Botzas | G09G 3/3406 345/102 |
| 2011/0181627 | A1* | 7/2011 | You | G09G 3/3406 345/690 |
| 2012/0075353 | A1 | 3/2012 | Dong et al. | |
| 2012/0194578 | A1 | 8/2012 | Znamenskiy et al. | |

* cited by examiner

*Primary Examiner* — Long D Pham
(74) *Attorney, Agent, or Firm* — Innovation Counsel LLP

(57) ABSTRACT

A display apparatus includes a display panel in which a plurality of pixel units are disposed, a backlight providing light to the display panel, and a data processing circuit receiving image signals and providing the image signals to the plurality of pixel units. The data processing circuit sets a luminance level of the backlight to a value corresponding to a color gamut boundary of the image signals adjacent to a saturation region.

19 Claims, 14 Drawing Sheets

<Histogram>

DISPLAY APPARATUS FOR ADJUSTING BACKLIGHT LUMINANCE BASED ON COLOR GAMUT BOUNDARY AND DRIVING METHOD THEREOF

CROSS-REFERENCE TO RELATED APPLICATIONS

This U.S. non-provisional patent application claims priority under 35 U.S.C. § 119 of Korean Patent Application No. 10-2015-0025355, filed on Feb. 23, 2015, the disclosure of which is hereby incorporated by reference in its entirety.

BACKGROUND

The present disclosure relates to a display apparatus and a driving method thereof, and more particularly, to a display apparatus and driving method thereof for improving a display quality. Typical displays represent colors using primary colors, for example, red, green, and blue colors. Accordingly, a display panel of a typical display includes pixels displaying red, green, and blue colors.

Recently, a display device that displays colors using a primary color in addition to red, green, blue colors has been developed. The primary color may be any one of magenta, cyan, yellow, and white colors, or any combination thereof. In particular, a display device that includes red, green, blue, and white pixels has been developed to improve luminance of a displayed image. Such a display device receives red, green, and blue image signals and converts them into red, green, blue, and white data signals. The red, green, blue, and white data signals are provided to corresponding red, green, blue, and white pixels, respectively, and an image is displayed by the red, green, blue, and white pixels.

SUMMARY

The present disclosure provides a display apparatus and a driving method thereof for improving a display quality.

According to an embodiment of the present disclosure, a display apparatus includes: a display panel in which a plurality of pixel units are disposed; a backlight providing light to the display panel; and a data processing circuit receiving image signals and providing the image signals to the plurality of pixel units. The data processing circuit sets a luminance level of the backlight to a value corresponding to a color gamut boundary of the image signals adjacent to a saturation region.

In some embodiments, the data processing circuit includes a data processing unit mapping the image signals to a color gamut of the display apparatus and providing mapped image signals; and a backlight luminance controller setting the luminance level of the backlight to the value corresponding to the color gamut boundary of the image signals adjacent to the saturation region by using the mapped image signals.

In other embodiments, the data processing unit converts the image signals including red, green, and blue image signals into color mapped image signals including red, green, blue, and white image signals.

In still other embodiments, each of the plurality of pixel units includes a first pixel group including two of red, green, blue, and white pixels; and a second pixel group including remaining two of the red, green, blue, and white pixels.

In even other embodiments, the data processing unit includes an input gamma unit receiving the image signals and providing linearized the image signals; a color gamut mapping unit mapping the linearized image signals to the color gamut of the display apparatus and providing color mapped image signals; a clamping unit converting the color mapped image signals received from the color gamut mapping unit to clamped image signals corresponding to the luminance level determined by the backlight luminance controller within a color gamut range corresponding to the luminance level; a sub pixel rendering unit receiving the clamped image signals from the clamping unit and providing rendered image signals corresponding to pixels of the pixel units; and an output gamma unit receiving the rendered image signals and performing reverse gamma correction.

In yet other embodiments, the backlight luminance controller includes a histogram analyzing unit receiving pixel luminance data defined as a maximum value among data values of the color mapped image signals corresponding to each of the pixel units among the color mapped image signals mapped by the color gamut mapping unit, dividing the luminance level for the backlight into a predetermined number of bins, and counting a number of pixel luminance data included in a level range of each of the bins; and a luminance level determining unit, when an i-th bin corresponds to a bin weight interval defined as an interval from a maximum bin to a bin including a predetermined luminance level value, multiplying a value of the i-th bin by a bin weight and accumulating a value of an (i+1)-th bin to the i-th bin, wherein the luminance level determining unit, when the value of the i-th bin is greater than a threshold value, determining the luminance level of the backlight by using a luminance level corresponding to the value of the i-th bin.

In further embodiments, when the value of the i-th bin is not greater than the threshold value, the luminance level determining unit decreases an index i by 1 to move to a lower bin.

In still further embodiments, a value of the bin weight is greater than 1 and the value of the bin weight may become smaller as the index i is moved from the maximum bin to a minimum bin in the bin weigh interval.

In even further embodiments, a maximum bin weight multiplied by the maximum bin is set so that a value obtained by multiplying a number of minimum view pixels defined as a minimum number of pixel units by the maximum bin weight is greater than the threshold value.

In yet further embodiments, when the pixel luminance data is 8-bit data, the predetermined luminance level may be set to a luminance level of 200.

In much further embodiments, the backlight luminance controller further includes a color weight unit multiplying the color mapped image signals mapped by the color mapping unit by weights, respectively, and determining the pixel luminance data among the color mapped image signals multiplied by the weights to provide the determined pixel luminance data to the luminance level determining unit; and a smoothing unit correcting the luminance level determined by the luminance level determining unit with a median value of luminance values of a previous frame and a current frame and outputting the median value.

In other embodiments of the present disclosure, a driving method of a display apparatus, includes: mapping image signals and providing mapped image signals to pixel units of a display panel of the display apparatus to a color gamut of the display apparatus; setting a luminance level of a backlight to a value corresponding to image signals adjacent to a saturation region by using the mapped image signals; and generating light corresponding to the luminance level to provide the light to the pixel units.

BRIEF DESCRIPTION OF THE DRAWINGS

The accompanying drawings are included to provide a further understanding of the present disclosure, and are incorporated in and constitute a part of the present specification. The drawings illustrate exemplary embodiments of the present disclosure and, together with the detailed description, serve to explain principles of the present disclosure. In the drawings.

DETAILED DESCRIPTION OF THE EMBODIMENTS

Advantages and features of the present disclosure, and methods for improving a display quality will be explained with reference to exemplary embodiments described later in detail together with the accompanying drawings. However, the present disclosure is not limited to the following exemplary embodiments, but can be realized in various forms. The present exemplary embodiments are provided to make a person having an ordinary skill in the art to understand the scope of the present disclosure. The present disclosure may be defined by the scope of the accompanying claims. Throughout the present specification, like numerals refer to like elements.

When an element or a layer is referred to as being 'on' another element or layer, it can be directly on the other element or layer, or one or more intervening layers or elements may also be present. In contrast, when an element or layer is referred to as being "directly on" another element or layer, there may be no intervening elements or layers present. The term "and/or" includes any and all combinations of each and one or more of the associated listed items.

Spatially relative terms, such as "above," "upper," "beneath," "below," "lower," and the like, may be used herein for ease of description to describe one element or feature's relationship to other elements or features. It will be understood that the spatially relative terms may encompass a different orientation of the device in use or operation in addition to the orientation depicted in the figures. Throughout the present specification, like numerals refer to like elements.

Also, though terms like a first and a second are used to describe various members, components, and/or sections in various embodiments of the present disclosure, the members, components, and/or sections may not be limited to these terms. These terms are used only to differentiate one member, component, or section from another one. Therefore, a first member, a first component, or a first section referred to herein can be referred to as a second member, a second component, or a second section within the scope of the present disclosure.

Exemplary embodiments are described herein with reference to cross-sectional views and/or plan views that are schematic illustrations of the exemplary embodiments. As such, variations from the shapes of the illustrations as a result, for example, of manufacturing techniques and/or tolerances, are to be expected. Thus, exemplary embodiments should not be construed as limited to the particular shapes of regions illustrated herein but may include deviations in shapes that result, for example, from manufacturing techniques and/or tolerances. Thus, the regions illustrated in the figures are schematic in nature, and their shapes may or may not illustrate an actual shape of a region of a device. Hereinafter, it will be described in detail about an exemplary embodiment of the present disclosure in conjunction with the accompanying drawings.

Figure 1:
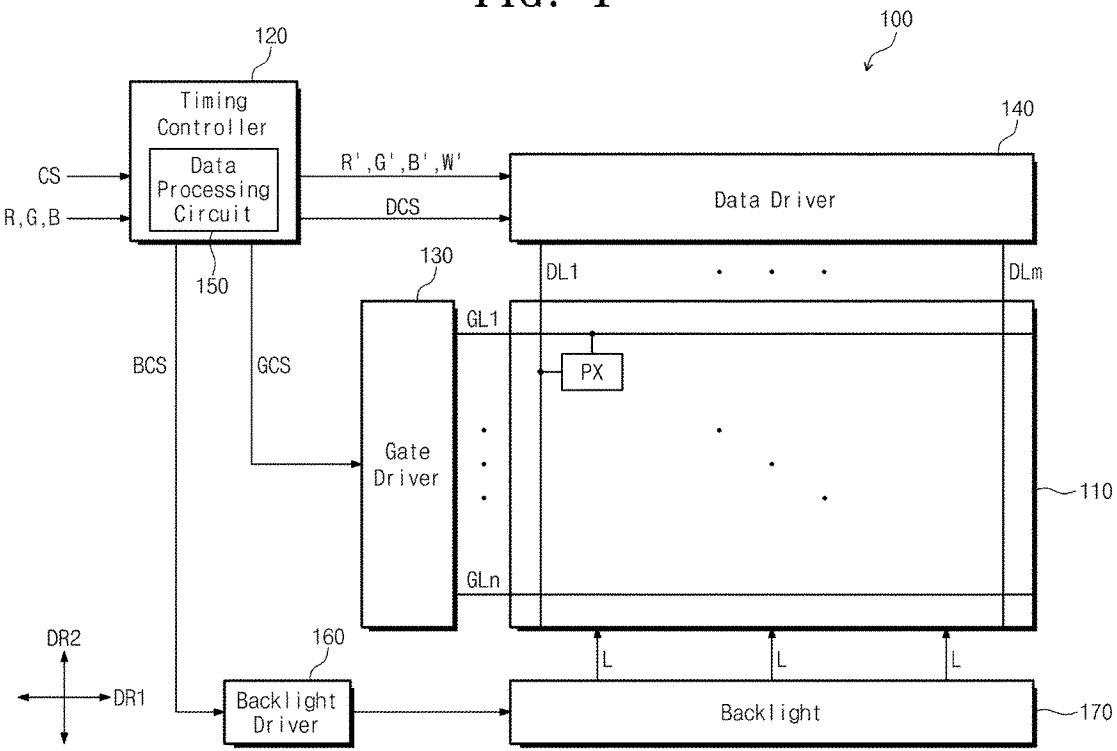
FIG. 1 is a block diagram of a display apparatus according to one embodiment of the present disclosure.

FIG. 1 is a block diagram of a display apparatus according to an embodiment of the present disclosure. A display apparatus 100 includes a display panel 110, a timing controller 120, a gate driver 130, a data driver 140, a backlight driver 160, and a backlight 170. The display panel 110 may be a liquid crystal display panel that includes two opposite substrates and a liquid crystal layer that is between the two substrates. The display panel 110 includes a plurality of gate lines GL1 to GLn, a plurality of data lines DL1 to DLm, and a plurality of pixels PX. Here, m and n are natural numbers. The gate lines GL1 to GLn are extended in a first direction DR1 and are connected to the gate driver 130. The data lines DL1 to DLm are extended in a second direction DR2 that intersects with the first direction DR1 and are connected to the data driver 140.

The pixels PX are disposed in areas divided by the gate lines GL1 to GLn and data lines DL1 to DLm that intersect with each other. Accordingly, the pixels PX may be arranged in a matrix type. The pixels PX are connected to gate lines GL1 to GLn and data lines DL1 to DLm. Each pixel PX may display one of the primary colors. The primary colors may include red, green, blue, and white. However, the primary colors are not limited thereto and may further include various colors such as yellow, cyan, and magenta.

According to one embodiment, the timing controller 120 is mounted on a printed circuit board in an integrated circuit chip type and connected to the gate driver 130 and the data driver 140. The timing controller 120 receives image signals R, G, and B and a control signal CS from an external device (e.g., a system board). The image signals R, G, and B include a red image signal R, a green image signal G, and a blue image signal B. The timing controller 120 generates the red, green, blue, and white image signals by using the image signals R, G, and B.

The timing controller 120 converts a data format of the red, green, blue, and white image signals R, G, and B to image signals R', G', B', and W' to be matched with the interface specification of the data driver 140. The timing controller 120 provides the converted image signals R', G', B', and W' to the data driver 140.

The timing controller 120 generates a backlight control signal BCS for controlling luminance of the backlight 170 by using the red, green, blue, and white image signals. The backlight control signal BCS is provided to the backlight driver 160. According to one embodiment, the timing controller 120 includes a data processing circuit 150 for generating the red, green, blue, and white image signals R', G', B', and W' by using the image signals, R, G, and B. The data processing circuit 150 further generates the backlight control signal BCS by using the red, green, blue, and white image signals R', G', B', and W'. According to some embodiments, the image signals may have a gradation value between 0 and 255. The image signals may have low gradations. When the backlight 170 emits light of luminance of about 100%, the power consumption may become excessively increased.

The data processing circuit 150 analyzes gradation values of the red, green, blue, and white image signals, and sets the luminance level of the backlight 170 based on the analyzed data. As a result, the power consumption of the backlight 170 may be reduced.

In one embodiment, the data processing circuit 150 sets the luminance level of the backlight 170 to a value corresponding to a color gamut boundary of image signals viewed by a user and adjacent to a saturated color region. The set luminance level of the backlight 170 is output as the backlight control signal BCS. A configuration and operation of the data processing circuit 150 will be described in detail below.

The control signal CS may include a vertical sync signal that is a frame distinction signal, a horizontal sync signal that is a row distinction signal, a data enable signal that has a high level only during a period of data output for displaying a region of data input, and a main clock signal. The timing controller 120 creates a gate control signal GCS and a data control signal DCS in response to the control signal CS. The gate control signal GCS is a control signal for controlling an operation timing of the gate driver 130. The data control signal DCS is a control signal for controlling an operation timing of the data driver 140. The gate control signal GCS may include a scan start signal for instructing a scan start, at least one clock signal for controlling an output period of a gate-on voltage, and an output enable signal limiting a gate-on voltage maintaining time. The data control signal DCS may include a horizontal start signal notifying that the image signals R', G', B', and W' start to be transmitted to the data driver 140, a load signal that is a command signal for applying a data voltage to the data lines DL1 to DLm, and a polarity control signal for determining polarity of a data voltage for a common voltage.

The timing controller 120 provides the gate control signal GCS to the gate driver 130 and the data control signal DCS to the data driver 140. The gate driver 130 creates gate signals in response to the gate control signal GCS. The gate signals may be sequentially output. The gate signals are provided in a unit of rows to the pixels PX through the gate lines GL1 to GLn. The data driver 140 creates data voltages based on the image signals R', G', B', and W' in response to the data control signal DCS. The data voltages are provided to the pixels PX through the data lines DL1 to DLm.

The gate and data drivers 130 and 140 may be formed with a plurality of driving chips mounted on a flexible printed circuit board and connected to the display panel 110 in a tape carrier package (TCP). However, the gate and data drivers 130 and 140 are not limited thereto and may be formed with a plurality of driving chips mounted on the display panel 110, for example, in a chip on glass (COG) manner. In addition, the gate driver 130 may be simultaneously formed with transistors of the pixels PX mounted on the display panel 110 in an amorphous silicon TFT gate driver circuit (ASG).

The backlight driver 160 drives the backlight 170 to allow the backlight 170 to generate light L having a luminance level in response to the backlight control signal BCS. The backlight 170 may be disposed on a rear side of the display panel 110. The backlight 170 may include light emitting diodes or a cold cathode fluorescent lamp for generating light L. The light L generated by the backlight 170 is provided to the display panel 110.

The pixels PX receive the data voltages through the data lines DL1 to DLm in response to the gate signals provided through the gate lines GL1 to GLn. The image may be displayed with the pixels PX displaying gradations corresponding to the data voltages. The pixels PX that are driven by the data voltages display the image by controlling transmission of the light provided from the backlight 170.

Figure 2:
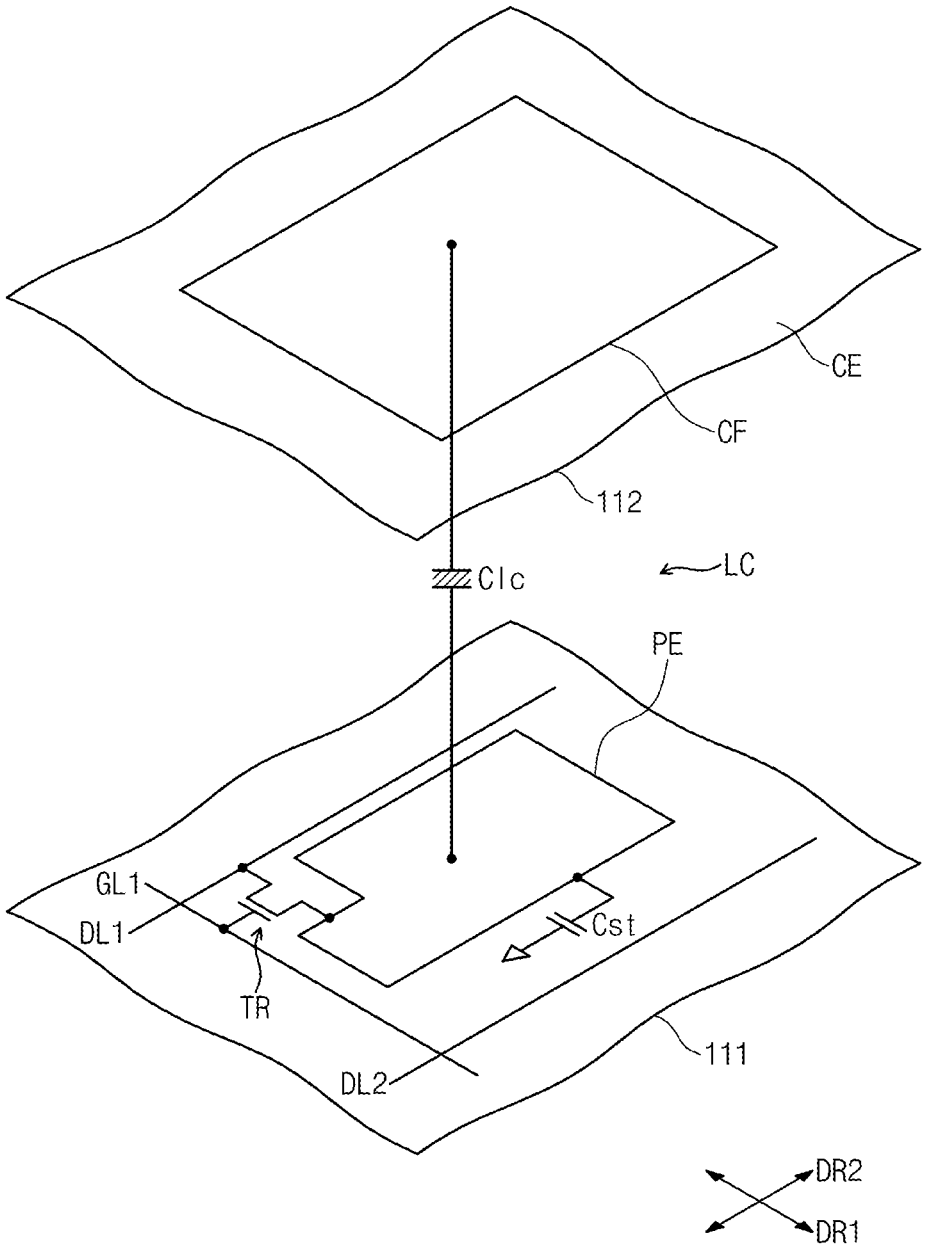
FIG. 2 is an equivalent circuit diagram of the pixel illustrated in FIG. 1.

FIG. 2 is an equivalent circuit diagram of the pixel illustrated in FIG. 1. For convenience of explanation, a pixel PX connected to a second gate line G2 and a first data line D1 is illustrated in FIG. 2. The display panel 110 includes a first substrate 111, a second substrate 112 facing the first substrate 111, and a liquid crystal layer LC disposed between the first and second substrates 111 and 112. The pixel PX includes a transistor TR connected to the first gate line GL1 and the first data line DL1, a liquid crystal capacitor Clc connected to the transistor TR, and a storage capacitor Cst connected to the liquid crystal capacitor Clc in parallel. The storage capacitor Cst may be omitted.

The transistor TR may be disposed on the first substrate 111. The transistor TR includes a gate electrode connected to the first gate line GL1, a source electrode connected to the first data line DL1, and a drain electrode connected to the liquid crystal capacitor Clc and the storage capacitor Cst.

The liquid crystal capacitor Clc includes a pixel electrode PE disposed on the first substrate 111, a common electrode CE disposed on the second substrate 112, and the liquid crystal layer LC disposed between the pixel electrode PE and the common electrode CE. The liquid crystal layer LC plays a role of a dielectric. The pixel electrode PE is connected to the drain electrode of the transistor TR.

In FIG. 2, the pixel electrode PE is a non-slit structure but is not limited thereto. For example, the pixel electrode PE may have a slit structure including a stem part in a cross shape and a plurality of branch parts that are extended from the stem part in a radial form.

The common electrode CE may be entirely formed on the second substrate 112. However the common electrode CE is not limited thereto and may be disposed on the first substrate 111. In some embodiments, at least one of the pixel electrode PE and the common electrode CE may include a slit.

The storage capacitor Cst may include the pixel electrode PE, a storage electrode (not illustrated) branched from a storage line (not illustrated), and an insulation layer disposed between the pixel electrode PE and the storage electrode. The storage line may be disposed on the first substrate 111 and simultaneously formed on an identical layer with the gate lines GL1 to GLn. The storage electrode may be partially overlapped with the pixel electrode PE.

The pixel PX may further include a color filter CF representing one of primary colors. In an exemplary embodiment, the color filter CF may be disposed on the second substrate 112, as illustrated in FIG. 2. However, the color filter CF is not limited thereto and may be disposed on the first substrate 111.

The transistor TR is turned on in response to a gate signal provided through the first gate line GL1. A data voltage received through the first data line DL1 is provided to the pixel electrode PE of the liquid crystal capacitor Clc through the turned on transistor TR. A common voltage is applied to the common electrode CE.

An electric field is formed between the pixel electrode PE and the common electrode CE by a level difference between the data voltage and the common voltage. Liquid crystal molecules of the liquid crystal layer LC are driven by the electric field formed between the pixel electrode PE and the common electrode CE. Transmission of the light provided from the backlight 170 may be adjusted by the liquid crystal molecules driven by the electric field to display the image.

A storage voltage having a constant voltage level may be applied to the storage line. However, the storage voltage is not limited thereto and may receive a common voltage. The storage capacitor Cst plays a role for making up for a voltage charged in the liquid crystal capacitor.

Figure 3:
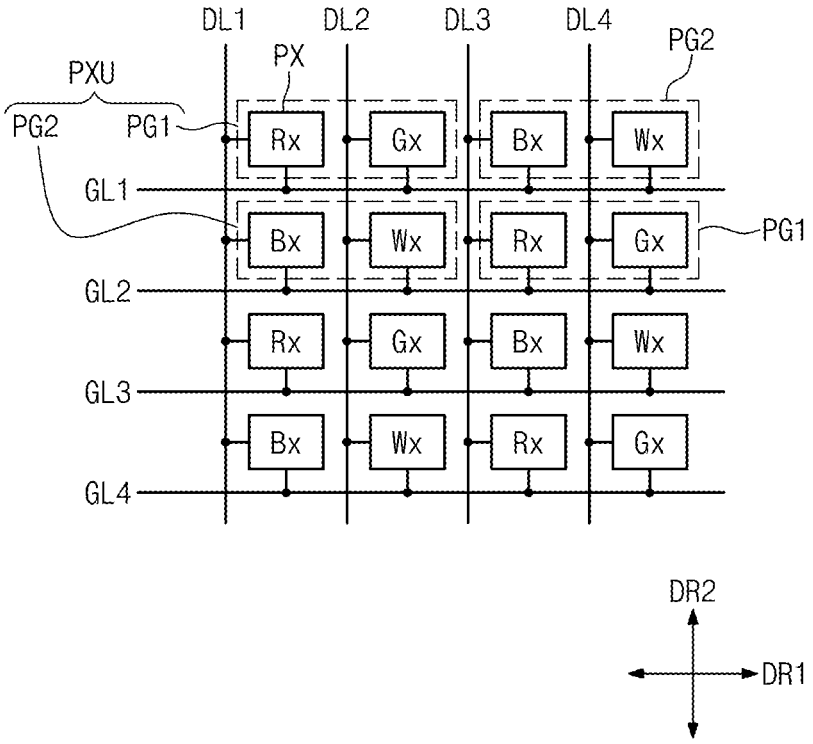
FIG. 3 is a plan view illustrating a part of the display panel illustrated in FIG. 1.

FIG. 3 is a plan view illustrating a part of the display panel illustrated in FIG. 1. For convenience of explanation, FIG. 3 illustrates pixels PX that are connected to the first to fourth gate lines GL1 to GL4 and first to fourth data lines DL1 to DL4. Referring to FIG. 3, the pixels PX are connected to corresponding gate lines among the gate lines GL1 to GL4 and corresponding data lines among the data lines DL1 to DL4. The pixels PX include a plurality of red pixels Rx representing a red color, a plurality of green pixels Gx representing a green color, a plurality of blue pixels Bx representing a blue color, and a plurality of white pixels Wx representing a white color. However, the pixels PX are not limited thereto and may include yellow pixels, cyan pixels, and magenta pixels respectively representing yellow, cyan, and magenta colors. The red, green, blue, and white image signals R', G', B', and W' are converted to data voltages and provided to the red, green, blue, and white pixels Rx, Gx, Bx, and Wx. The pixels PX may be grouped into a plurality of first pixel groups PG1 and a plurality of second pixel groups PG2. The first and second pixel groups PG1 and PG2 may be disposed alternately in the first and second directions DR1 and DR2. However, a disposition of the pixel groups is not limited to the first and second pixel groups PG1 and PG2 illustrated in FIG. 3 and may be diversely set without deviating from the scope of the present disclosure.

For example, identical pixel groups may be disposed on an identical row, and the first and second pixel groups PG1 and PG2 may be repeatedly and alternately disposed in the second direction DR2. In addition, identical pixel groups may be disposed on an identical row, and the first and second pixel groups PG1 and PG2 may be repeatedly and alternately disposed in the first direction DR1.

The first and second pixel groups PG1 and PG2 may respectively include 2k pixels PX. Here, k is a natural number. In other words, each of the first and second pixel groups PG1 and PG2 may include the even number of pixels PX. As an exemplary embodiment, k may be 1, and in this case, as illustrated in FIG. 3, the first and second pixel groups PG1 and PG2 may respectively include two pixels PX.

Each of the first pixel groups PG1 may include two of a red pixel Rx, a green pixel Gx, a blue pixel Bx, and a white pixel Wx, and each of the second pixel groups PG2 may include the remaining two of the red pixel Rx, the green pixel Gx, the blue pixel Bx, and the white pixel Wx. In other words, each of the first and second pixel groups PG1 and PG2 may display different colors.

For example, as illustrated in FIG. 3, each of the first pixel groups PG1 may include a red pixel Rx and a green pixel Gx. Each of the second pixel groups PG2 may include a blue pixel Bx and a white pixel Wx. However, a disposition configuration of the pixels PX is not limited to the disposition configuration illustrated in FIG. 3 and may be diversely set.

In another example, each of the first pixel groups PG1 may include a red pixel Rx and a blue pixel Bx, and each of the second pixel groups PG2 may include a green pixel Gx and a white pixel Wx. In addition, each of the first pixel groups PG1 may include a red pixel Rx and a white pixel Wx, and each of the second pixel groups PG2 may include a green pixel Gx and a blue pixel Bx.

A pixel unit PXU is defined as a minimum unit for displaying an image. The pixel unit PXU may include the first and second pixel groups PG1 and PG2 adjacent to each other in the first direction DR1. A plurality of pixel units PXU are disposed on the display panel 110, and each of the plurality of pixel units PXU includes a red pixel Rx, a blue pixel Bx, a green pixel Gx, and a white pixel Wx.

Figure 4:
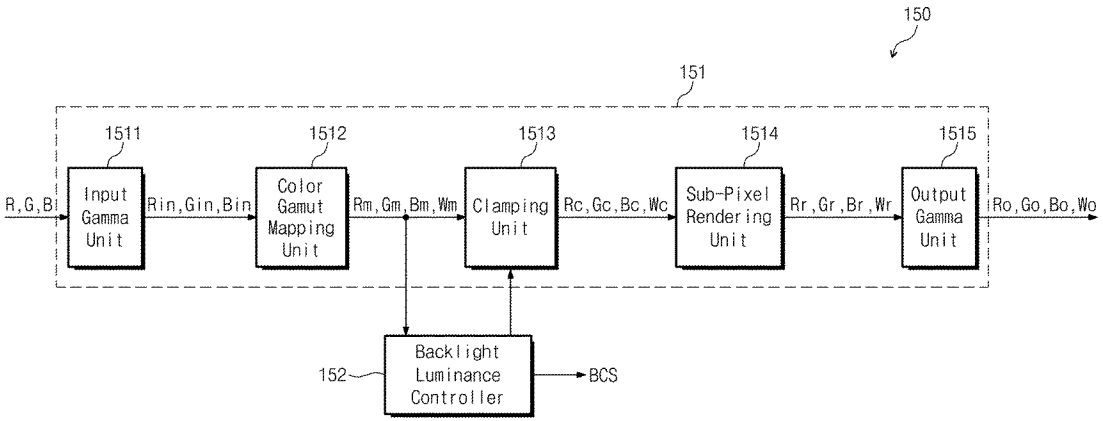
FIG. 4 is a block diagram of the data processing circuit illustrated in FIG. 1.

FIG. 4 is a block diagram of the data processing circuit illustrated in FIG. 1. Referring to FIG. 4, the data processing circuit 150 includes a data processing unit 151 that processes the image signals R, G, and B to image signals suitable for the display apparatus and a backlight luminance controller 152 that determines a luminance value of the backlight 170. The data processing unit 151 maps the image signals R, G, and B to a color gamut of the display apparatus 100 and converts them to image signals suitable for a red pixel Rx, blue pixel Bx, green pixel Gx, and white pixel Wx and output the image signals.

The data processing unit 151 includes an input gamma unit 1511, a color gamut mapping unit 1512, a clamping unit 1513, a sub-pixel rendering unit 1514, and an output gamma unit 1515. The input gamma unit 1511 receives image signals R, G, and B. The image signals R, G, and B may have nonlinear characteristics. The input gamma unit 1511 linearizes the red, green, and blue image signals R, G, and B having the nonlinear characteristics by applying a gamma function to the red, green, and blue image signals R, G, and B.

The software implementation of data processing in subsequent blocks after the input gamma unit 1511 by using the image signals R, G, and B is difficult because of the nonlinear characteristics of the image signals R, G, and B. The input gamma unit 1511 linearizes the image signals R, G, and B to facilitate data processing in the subsequent blocks after the input gamma unit 1511. The linearized red, green, and blue image signals Rin, Gin, and Bin are provided to the color gamut mapping unit 1512.

The color gamut unit 1512 maps the linearized image signals to a color gamut of the image signals for displaying them on the display apparatus 100. For example, the color gamut mapping unit 1512 generates red, green, blue, and white image signals Rm, Gm, Bm, and Wm by using the linearized red, green, and blue image signals Rin, Gin, and Bin.

The color gamut mapping unit 1512 calculates a white ratio WR with reference to Equation (1).

$$WR = \frac{L_w}{L_R + L_G + L_B} = m_2, \quad (1)$$

where, $L_R$ is a luminance level of a red color, $L_G$ is a luminance level of a green color, $L_B$ is a luminance level of a blue color, and $L_W$ is a luminance level of a white color.

The color gamut mapping unit 1512 generates red, green, blue, and white image signals Rm, Gm, Bm, and Wm according to Equation (2) by using a White ratio.

$$2R_m=R_{in}(1+m_2)-2m_2W_m;$$

$$2G_m=G_{in}(1+m_2)-2m_2W_m;$$

$$2B_m=B_{in}(1+m_2)-2m_2W_m;$$

$$2m_2W_m=(2R_{in}+5G_{in}+B_{in})/8;$$

$$\max(R_{in},G_{in},B_{in})(1+m_2)-1\leq 2m_2W_m\leq \min(R_{in},G_{in},B_{in})(1+m_2) \quad (2)$$

In addition, the color gamut mapping unit 1512 maps an RGB color gamut by the red, green, and blue image signals Rin, Gin, and Bin to an RGBW color gamut by the red, green, blue, and white image signals Rm, Gm, Bm, and Wm by using a gamut mapping algorithm (GMA). The input image signals R, G, and B are image signals suitable for a display apparatus for displaying the red, green, and blue image signals. However, the display apparatus 100 displays the red, green, blue, and white image signals. Accordingly, the color gamut mapping unit 1512 converts the red, green, and blue image signals Rin, Gin, and Bin to the red, green, blue, and white image signals Rm, Gm, Bm, and Wm and maps the red, green, blue, and white image signals Rm, Gm, Bm, and Wm to a color gamut suitable for the display device 100. The red, green, blue, and white image signals Rm, Gm, Bm, and Wm output from the color gamut mapping unit 1512 are provided to the backlight luminance controller 152 and the clamping unit 1513.

The backlight luminance controller 152 determines a luminance level of the backlight 170 by using a histogram based on the red, green, blue, and white image signals Rm, Gm, Bm, and Wm. In addition, the backlight luminance controller 152 sets the luminance level of the backlight 170 to a value corresponding to a color gamut boundary of image signals having a maximum gradation among the image signals Rm, Gm, Bm, and Wm. A configuration and operation of the backlight luminance controller 152 will be described in detail below.

There may be image signals that are out of a color gamut range corresponding to the luminance level determined by the backlight luminance controller 152 among the red, green, blue, and white image signals Rm, Gm, Bm, and Wm that are output from the color gamut mapping unit 1512. The clamping unit 1513 receives a value of the luminance level determined by the backlight luminance controller 152. The clamping unit 1513 enables data values of the image signals out of the color gamut range corresponding to the luminance level determined by the backlight luminance controller 152 among the red, green, blue, and white image signals Rm, Gm, Bm, and Wm to be shortened to be within the color gamut corresponding to the luminance level. The clamping unit 1513 provides image signals Rc, Gc, Bc, and Wc that are converted to the color gamut to a sub-pixel rendering unit 1514.

The sub-pixel rendering unit 1514 includes a rendering filter (not illustrated) for performing a rendering operation. The sub-pixel rendering unit 1514 renders the red, green, blue, and white image signals Rc, Gc, Bc, and Wc by using the rendering filter. The sub-pixel rendering unit 1514 generates the red, green, blue, and white image signals Rr, Gr, Br, and Wr that are rendered through the rendering filter. The red, green, blue, and white image signals Rc, Gc, Bc, and Wc are reconfigured by the rendering operation to the red and green image signals Rr and Gr or the blue and white image signals Br and Wr according to structures of the first and second pixel groups PG1 and PG2 of the display panel 110. In other words, the sub-pixel rendering unit 1514 renders the red, green, blue, and white image signals Rc, Gc, Bc, and Wc into image signals corresponding to red and green pixels Rx and Gx of the first pixel group PG1 and blue and white pixels Bx and Wx of the second pixel group PG2.

The sub-pixel rendering unit 1514 provides the rendered red, green, blue, and white image signals Rr, Gr, Br, and Wr to the output gamma unit 1515. The output gamma unit 1515 performs inverse gamma correction on the red, green, blue, and white image signals Rr, Gr, Br, and Wr to convert the red, green, blue, and white image signals Rr, Gr, Br, and Wr into image data before the gamma correction. A data format of the inverse-gamma-corrected red, green, blue, and white image signals Ro, Go, Bo, and Wo is converted by the timing controller 120 and is provided to the data driver 140.

Figure 5:
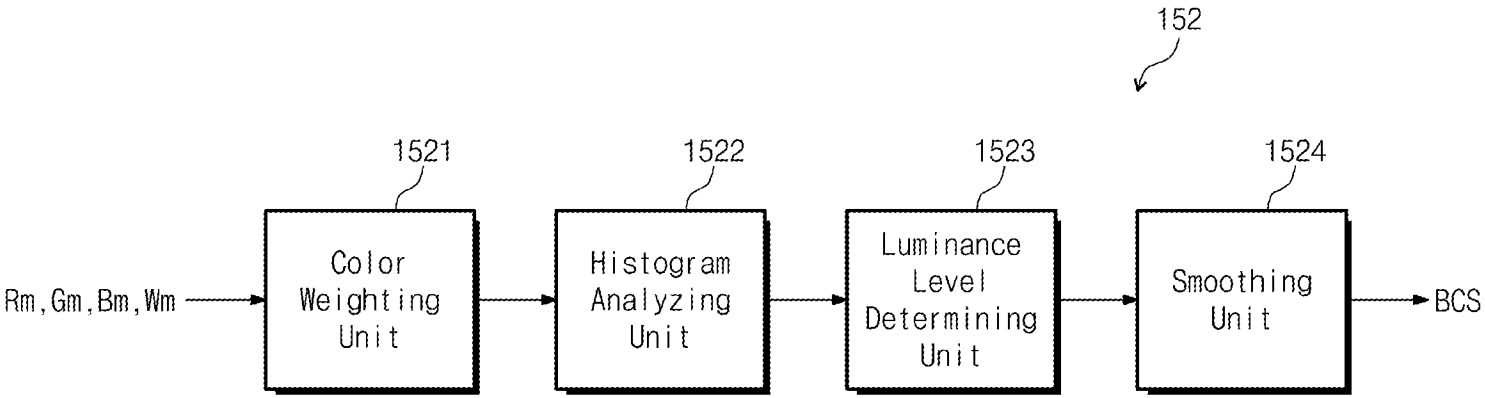
FIG. 5 is a block diagram of the backlight luminance controller illustrated in FIG. 4.
Figure 6:
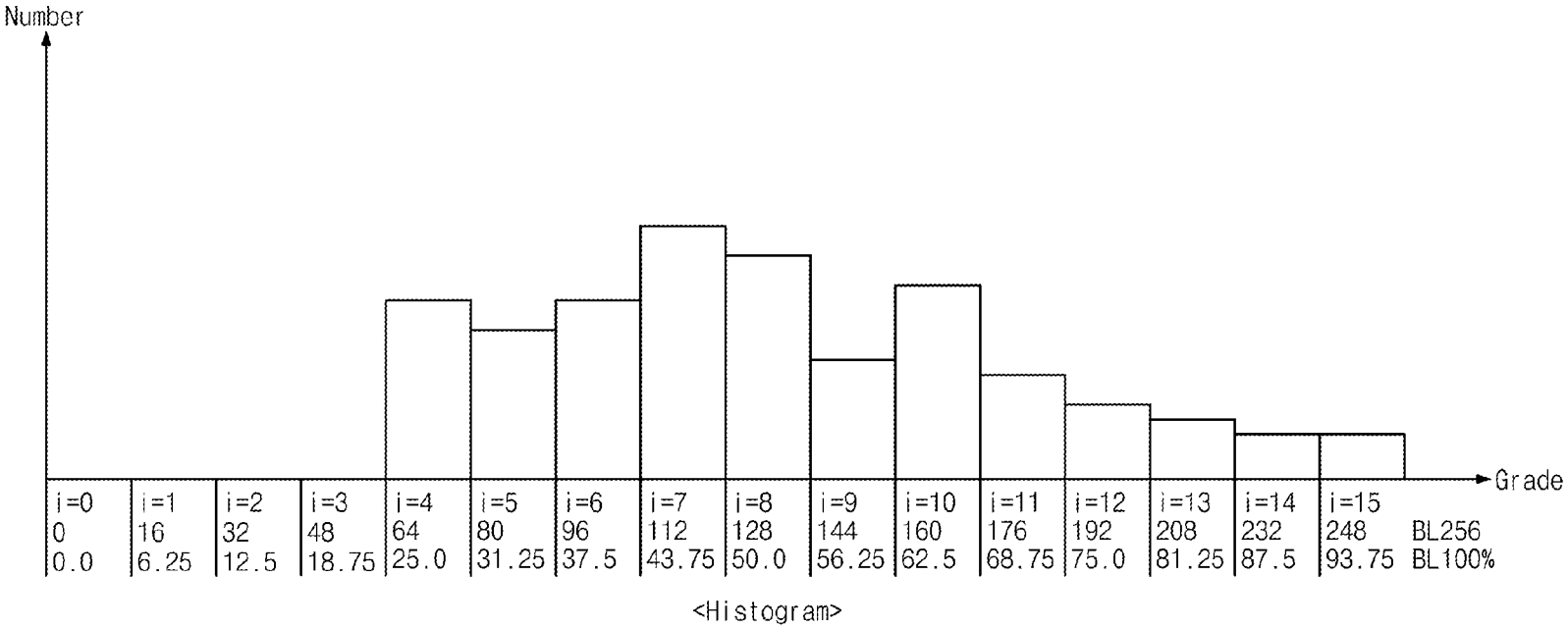
FIG. 6 is a conceptual diagram for explaining a histogram of the histogram analyzing unit illustrated in FIG. 5.
Figure 7:
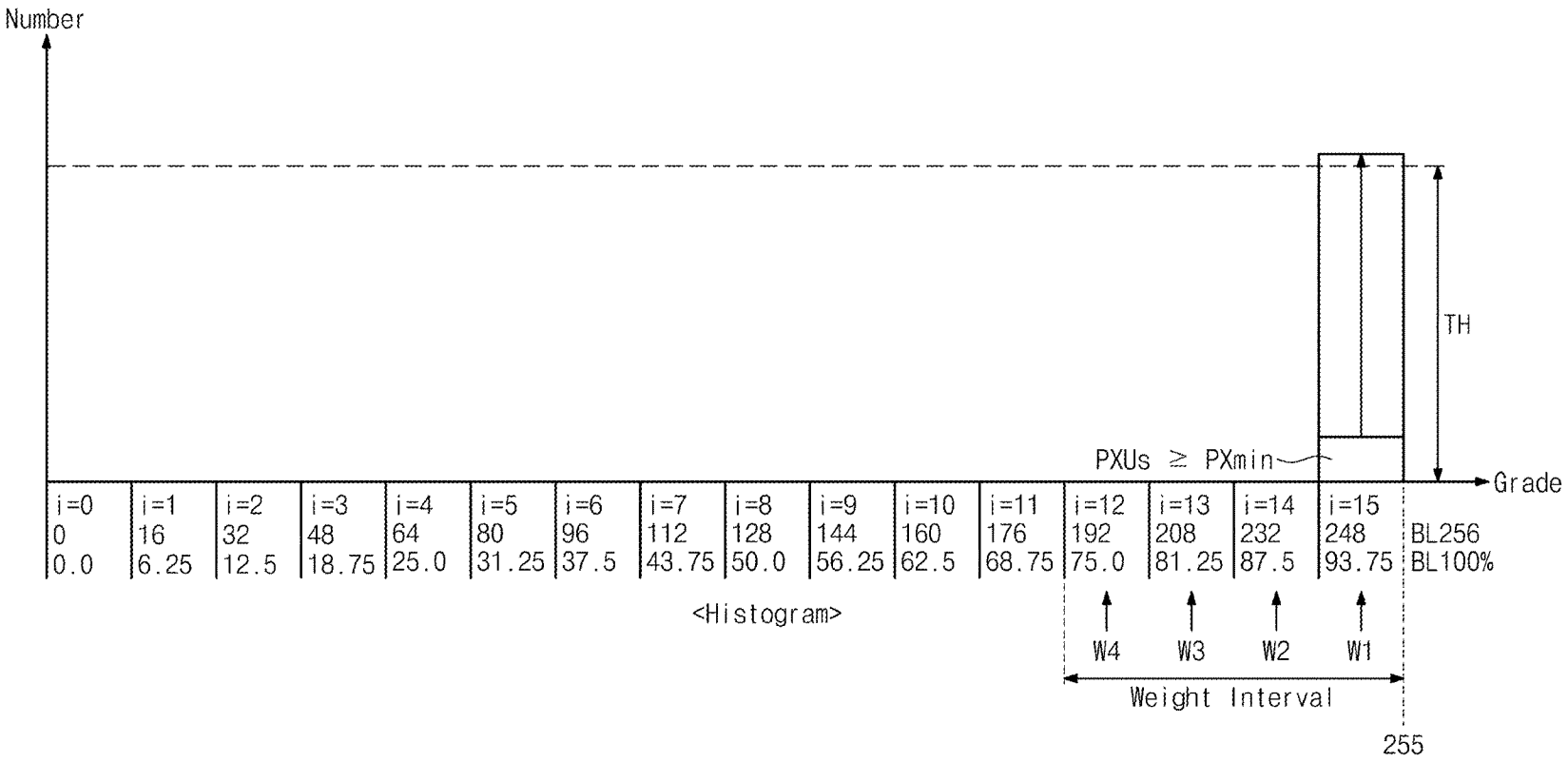
FIG. 7 is a conceptual diagram for explaining an operation of the luminance level determining unit illustrated in FIG. 5.

FIG. 5 is a block diagram of the backlight luminance controller illustrated in FIG. 4. FIG. 6 is a conceptual diagram for explaining a histogram of the histogram analyzing unit illustrated in FIG. 5. FIG. 7 is a conceptual diagram for explaining an operation of the luminance level determining unit illustrated in FIG. 5.

Referring to FIG. 5, the backlight luminance controller 152 includes a color weighting unit 1521, a histogram analyzing unit 1522, a luminance level determining unit 1523, and a smoothing unit 1524. The color weighting unit 1521 receives the red, green, blue, and white image signals Rm, Gm, Bm, and Wm. The color weighting unit 1521 multiplies the red, green, blue, and white image signals Rm, Gm, Bm, and Wm by a red weight RWT, a green weight GWT, a blue weight BWT, and a white weight WWT that are set according to a degree of contribution to luminance for each color.

The red, green, blue, and white data Rw, Gw, Bw, and Ww respectively multiplied by the red weight RWT, green weight GWT, blue weight BWT, and white weight WWT, and pixel luminance data PLD may be determined by Equation (3).

$$R_w=R_m\times RWT$$

$$G_w=G_m\times GWT$$

$$B_w=B_m\times BWT$$

$$W_w=W_m\times WWT$$

$$PLD=\max(R_w,G_w,B_w,W_w) \quad (3).$$

The pixel luminance data PLD is a maximum value among data of the red, green, blue, and white data Rw, Gw, Bw, and Ww that are multiplied by the red weight RWT, green weight GWT, blue weight BWT, and white weight WWT. For example, the maximum value of red, green, blue, and white data Rw, Gw, Bw, and Ww corresponding to the red, green, blue, and white pixel Rx, Gx, Bx, and Wx of each pixel unit PXU is the pixel luminance data PLD. In other words, the pixel luminance data PLD is the maximum value among data of the image signals corresponding to each pixel unit PXU.

Hereinafter, each of the red, green, blue, and white image signals Rm, Gm, Bm, and Wm is assumed to have 8-bit data. The color weighting unit 1521 normalizes the pixel luminance data PLD of the image signals multiplied by the weights to 8-bit data and provides the normalized data to the histogram analyzing unit 1522. Referring to FIG. 6, the histogram analyzing unit 1522 creates a histogram by dividing the luminance level for the backlight 170 into a predetermined number of grades and counting the number of the pixel luminance data PLD included in a level range of each grade.

When the pixel luminance data PLD is 8-bit data, the level range of the pixel luminance data PLD is 0 to 255, and the entire level of the pixel luminance data PLD may be divided into 16 grades. Accordingly, a histogram having 16 bins ($0 \le i \le 15$) is created. Here, i is a natural number. Each of the bins (i) represents a range in which pixel luminance values are not overlapped.

The vertical axis of the histogram of FIG. 6 represents a number of pixel units PXU in each bin (i), and the horizontal axis of FIG. 6 represents the luminance level of the backlight 170. Accordingly, a farther a bin (i) from an origin point on the horizontal axis represents a higher luminance level of the backlight 170. The histogram analyzing unit 1522 receives the pixel luminance data PLD and counts a bin (i) corresponding to a value of the pixel luminance data PLD. For example, a maximum value among red, green, blue, and white data Rw, Gw, Bw, and Ww corresponding to any one pixel unit may be red data Rw, and the red data Rw may have a value corresponding to a luminance level of 248 to 255. In this case, the histogram analyzing unit 1522 counts a value of bin (i=15) of a fifteenth grade that is a maximum grade, by 1. According to this operation, the number of pixel units PXU having the luminance level of each bin (i) as a maximum value may be accumulated to each bin (i). The luminance level determining unit 1523 determines the luminance level by using a histogram.

Referring to FIG. 7, when an i-th bin corresponds to a bin weight interval defined as an interval from the maximum bin (i=15) to a bin including a predetermined luminance level value, the luminance level determining unit 1523 multiplies a value of the i-th bin by bin weights W1, W2, W3, and W4, and accumulates a value of an (i+1)-th bin to the i-th bin while moving from a upper level bin to a lower level bin. The luminance level determining unit 1523 determines the luminance level of the backlight 170 by using a luminance level corresponding to the value of i-th bin, when the value of the i-th bin is greater than a threshold value TH. The luminance level determining unit 1523 moves to the lower bin by decreasing i by 1 when the value of the i-th bin is equal to or smaller than a threshold value TH. A predetermined luminance level value may be about 200. Accordingly, bin weights W1, W2, W3, and W4 from the fifteenth grade bin (i=15) to a twelfth grade bin (i=12) may be multiplied by each value of bin (i=15 to 12).

The value of bin weights W1, W2, W3, and W4 is greater than 1. The value of bin weights W1, W2, W3, and W4 becomes smaller as going from a maximum bin to a minimum bin in a bin weight interval. For example, the bin weights W1, W2, W3, and W4 include the first bin weight W1, the second bin weight W2, the three bin weight W3, and the fourth bin weight W4. The first bin weight W1 is the maximum bin weight W1 for being multiplied by the value of the fifteenth grade bin (i=15). The second bin weight W2 smaller than a first bin weight W1 is for being multiplied by a value of a fourteenth grade bin (i=14). The third bin weight W3 smaller than a second bin weight W2 is for being multiplied by a value of a thirteenth grade bin (i=13). The fourth bin weight W4 smaller than a third bin weight W3 is for being multiplied by a value of a twelfth grade bin (i=12).

In the bin weight interval, the maximum bin weight W1 multiplied by the maximum bin (i=15) is set to allow a value obtained by multiplying the minimum number of view pixels PXmin by the maximum bin weight W1 to be greater than the threshold value TH. Accordingly, when the maximum value of bin (i=15) is equal to or greater than the number of minimum view pixel number PXmin, the value obtained by multiplying the minimum number of view pixels PXmin by the maximum bin weight W1 is greater than the threshold value TH.

As the display apparatus 100 provides a higher resolution, the size of the pixel unit PXU becomes smaller. Resultantly, when a color is displayed with one pixel unit PXU, it is difficult to display the color by one pixel unit PXU.

In order to allow a user to view an image, pixel units PXU equal to or greater than the minimum number are required to display a color. The minimum number of pixel units PXU enabling a user to view am image is defined as a minimum number of view pixels PXmin. For example, the minimum number of view pixels PXmin may include pixel units PXU arranged in 7 rows and 7 columns. In this case, the minimum number of view pixels may be set to 49. When minimum 49 pixel units display a color, the user may view the color.

Referring to FIG. 7, the number of pixel units PXU corresponding to a value of maximum bin (i=15) may be equal to or greater than the minimum number of view pixels PXmin. The maximum bin weight W1 is multiplied by the value of the maximum bin (i=15).

When the maximum bin is the i-th bin (i.e., i=15), since there is no the (i+1)-th bin, the value of the maximum bin (i=15) is determined to be a value obtained by multiplying the value of the maximum bin (i=15) by the maximum bin weight W1. The value obtained by multiplying the value of the maximum bin (i=15) by the maximum bin weight W1 is greater than the threshold value TH. For example, the first bin weight W1 is 8, the second bin weight W2 is 6, the third bin weight W3 is 4, and the fourth bin weight W4 is 2. In addition, the threshold value TH is set to be 300. However, it is understood that the first to fourth weights W1 to W4 are not limited thereto and may be set to various values. When the value of maximum bin (i=15) is 49, a value obtained by multiplying the value of maximum bin (i=15) by the first weight W1 is greater than the threshold value 300. Since the value of maximum bin (i=15) multiplied by the first weight W1 is greater than the threshold value TH, the luminance level determining unit 1523 does not perform an operation of multiplying a value of the fourteenth grade bin (i=14), which is an (i−1)-th bin, by a weight and an operation of accumulating the value of bin (i) while moving from an upper bin to a lower bin of a histogram. The luminance level determining unit 1523 determines a luminance level by using the luminance level corresponding to the value of the fifteenth grade bin (i=15) because the luminance level is greater than the threshold value TH.

Referring to FIG. 5, the smoothing unit 1524 adjusts a deviation between the luminance levels of a previous frame and a current frame. For example, when the luminance level of the previous frame is 64 (with a reference of 8 bits) and the luminance level of the current frame determined by the luminance level determining unit 1523 is 255, a large luminance change may be viewed. According to one embodiment, the smoothing unit 1524 may correct the luminance level with a median value of luminance values of the previous frame and current frame. Accordingly, the luminance deviation viewed by an observer may be minimized.

Figure 8:
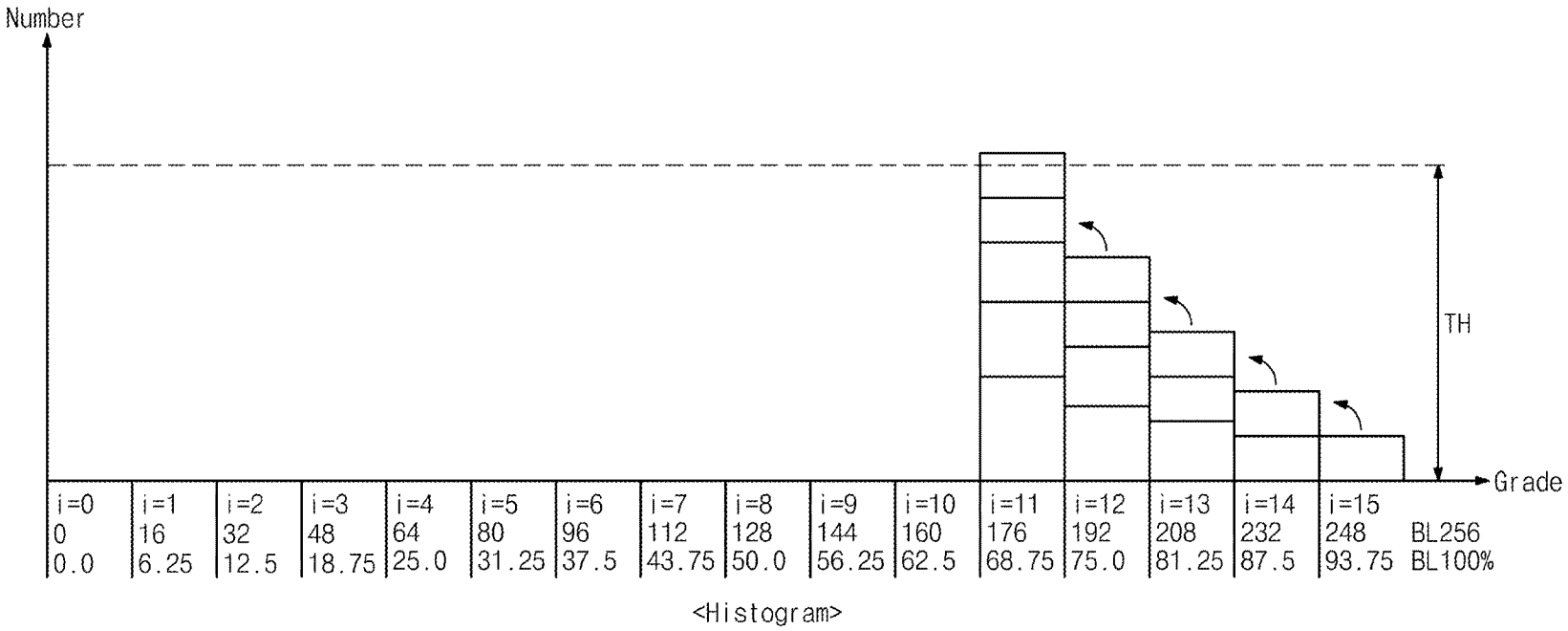
FIG. 8 is a conceptual diagram for explaining an operation of the luminance level determining unit to which a bin weight is not applied in the histogram illustrated in FIG. 6.

FIG. 8 is a conceptual diagram for explaining an operation of the luminance level determining unit to which a bin weight is not applied in the histogram illustrated in FIG. 6.

The luminance level determining unit 1523 does not apply a bin weight, but instead accumulates a value of bin (i) while moving from an upper bin to a lower bin of a histogram until the value of bin (i) becomes greater than the threshold value TH. The value of the fifteenth grade bin (i=15) is accumulated to the fourteenth grade bin (i=14), and the value of the fourteenth grade bin (i=14) is accumulated to the thirteenth grade bin (i=13). Such an operation is performed until the value accumulated to the bin (i) becomes greater than the threshold value TH. When a value of an eleventh grade bin (i=11) is greater than the threshold value TH, the luminance level determining unit 1523 does not apply a bin weight and determines the luminance level of the backlight 170 by using the luminance level corresponding to the value of the eleventh grade bin (i=11). In this case, the color gamut is determined to correspond to the luminance level of the eleventh grade bin (i=11). As a result, image signals corresponding to bins (i) having a greater grade than the eleventh grade bin (i=11) have values out of the color gamut. As described above, the clamping unit 154 converts the image signals Rm, Gm, Bm, and Wm having the values out of the color gamut into those within a color gamut range.

Since values of bins (i) having a greater grade than the eleventh grade bin (i=11) are equal to or greater than the minimum number of view pixels PXmin, the image is viewable to the user. In this case, the image signals corresponding to bins (i) having a greater grade than the eleventh grade bin (i=11) may be normally displayed by being displayed with a luminance level greater than that corresponding to the eleventh grade bin (i=11). However, the image signals corresponding to bins (i) having a greater grade than the eleventh grade bin (i=11) are substantially displayed with a luminance level corresponding to the eleventh grade bin (i=11). As a result, an image may be not normally displayed. Such a limitation may occur because the color gamut boundary is not set to a color gamut of the image signals. When a value of the luminance level is equal to or greater than 200, the value becomes greater as an image is closer to a saturation region corresponding to a maximum bin value.

In an embodiment of the present disclosure, in order to address the limitation, the value of the maximum bin (i=15) for which the above-described limitation may maximally occur is multiplied by the greatest bin weight W1 and bins (i=14, 13, and 12) are multiplied by bin weights W2, W3, and W4 decreasing step-by-step to the bin (i=12) including a luminance level value of 200. In addition, when the maximum value of bin (i=15) is equal to or greater than the number of minimum view pixel number PXmin, the greatest bin weight W1 is set so that a value obtained by multiplying the value of maximum bin (i=15) by the maximum bin weight W1 is greater than the threshold value TH.

As described in relation to FIGS. 6 and 7, when the value of the fifteenth grade bin (i=15) is equal to or greater than the minimum number of view pixels PXmin, the luminance level is determined by using the luminance level corresponding to the fifteenth grade bin (i=15). In this case, a color gamut corresponding to the luminance level is extended to a region corresponding to the luminance level of the fifteenth grade bin (i=15) according to an operation of the luminance level determining unit 1523 illustrated in FIG. 7, unlike the operation of the luminance level determining unit illustrated in FIG. 8. In other words, the luminance level of the backlight 170 is set to a value corresponding to a color gamut boundary of image signals viewed by the user and adjacent to a saturation color region. Accordingly, image signals corresponding to the fifteenth grade bin (i=15) that are adjacent to the saturation region may be normally displayed on the display panel 110.

Figure 9:
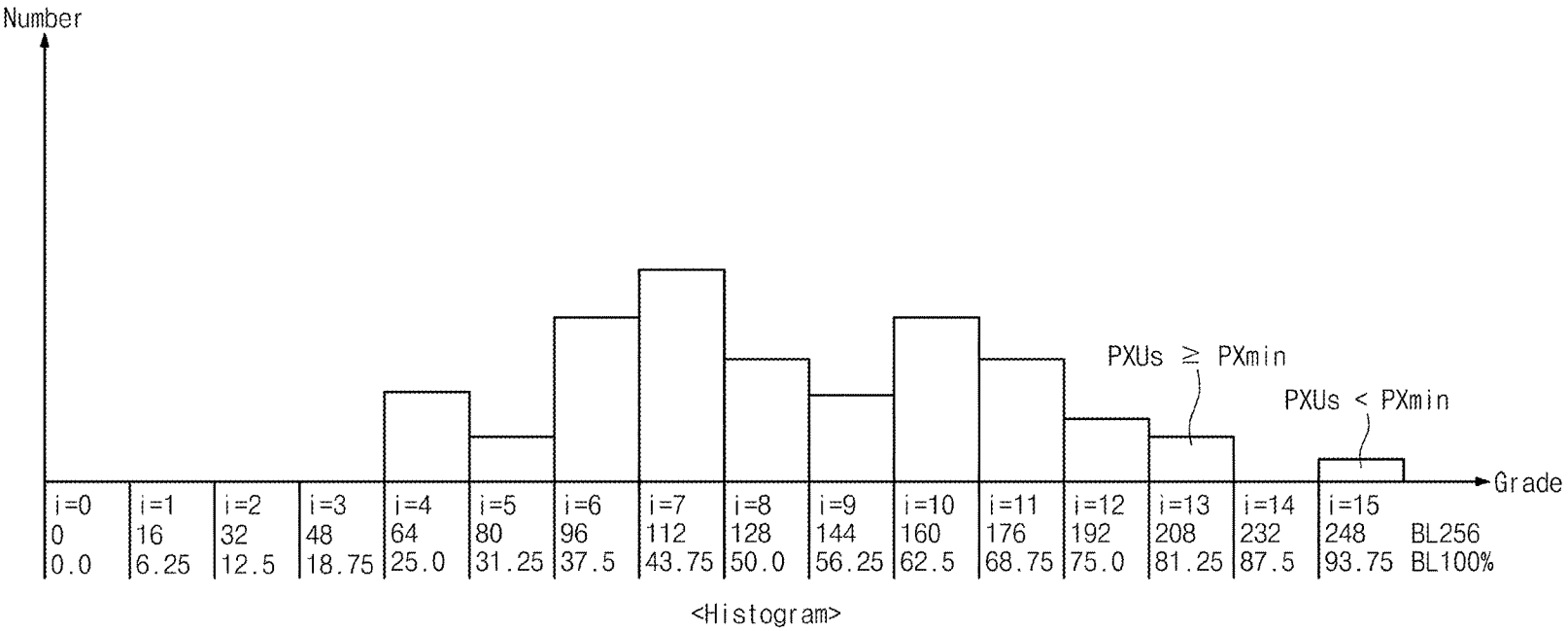
FIGS. 9 to 12 show histograms that are different from the histogram illustrated in FIG. 6 to explain an operation of the luminance level determining unit.
Figure 10:
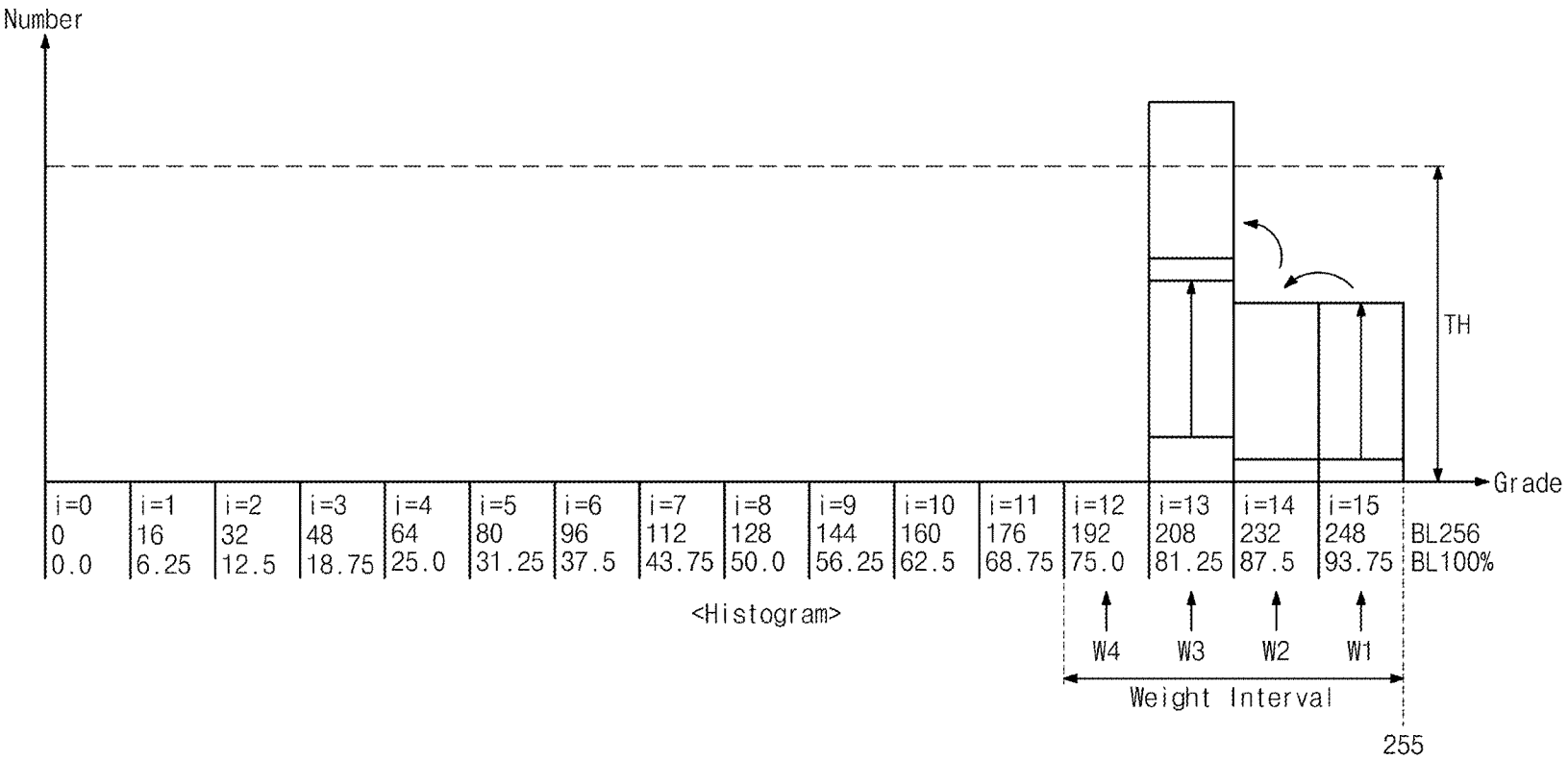

FIGS. 9 to 12 show histograms that are different from the histogram illustrated in FIG. 6 to explain the operation of the luminance level determining unit. Referring to FIGS. 9 and 10, the number of pixel units PXUs corresponding to the value of the fifteenth grade bin (i=15) is smaller than the minimum number of view pixels PXmin. The value of the fourteenth grade bin (i=14) is 0 and the number of pixel units PXUs corresponding to the value of the thirteenth grade bin (i=13) is equal to or greater than the minimum number of view pixels PXmin. The value obtained by multiplying the value of the maximum bin (i=15) by the maximum bin weight W1 is smaller than the threshold value TH. Since the value of the fourteenth grade bin (i=14) is 0, a value obtained by multiplying the value of the fourteenth grade bin (i=14) by the second weight W2 is 0. The value of the fifteenth grade bin (i=15) is accumulated to the fourteenth grade bin (i=14). Since the value of the fourteenth bin (i=14) is 0, the value accumulated to the fourteenth grade bin (i=14) is the same as that of the fifteenth grade bin (i=15) and smaller than the threshold value TH. The value of the thirteenth grade is multiplied by the third weight W3.

Since limitation described in relation to FIG. 8 becomes smaller as going from the fifteenth grade bin (i=15) to the twelfth grade bin (i=12), the bin weight multiplied by the bin also becomes smaller. In addition, when the value of the maximum bin is equal to or greater than the minimum number of view pixels PXmin, the maximum bin weight is set so that a value obtained by multiplying the maximum bin value by the maximum bin weight is greater than the threshold value. Accordingly, as illustrated in FIG. 10, a value obtained by multiplying the value of the thirteenth grade bin (i=13) by the third weight W3 may be smaller than the threshold value TH.

The value accumulated to the fourteenth grade bin (i=14) is accumulated to the value of thirteenth grade bin (i=13) having been multiplied by the third weight W3. As a result, the value of thirteenth bin (i=13) is greater than the threshold value TH. The luminance level determining unit 1523 determines the luminance level by using the luminance level corresponding to the value of the thirteenth bin (i=13), which is greater than the threshold value TH. Accordingly, the color gamut is set to a region corresponding to the luminance level of the thirteenth grade bin (i=13). The image signals corresponding to the fifteenth grade bin (i=15), which are image signals out of the color gamut, are moved into the color gamut range by the clamping unit 1513. Since smaller than the minimum number of view pixels PXmin, the value of the fifteenth grade bin (i=15) may not be viewed by the user. In other words, substantially, although an image corresponding to the fifteenth grade bin (i=15) is displayed, the limitation does not occur.

Figure 11:
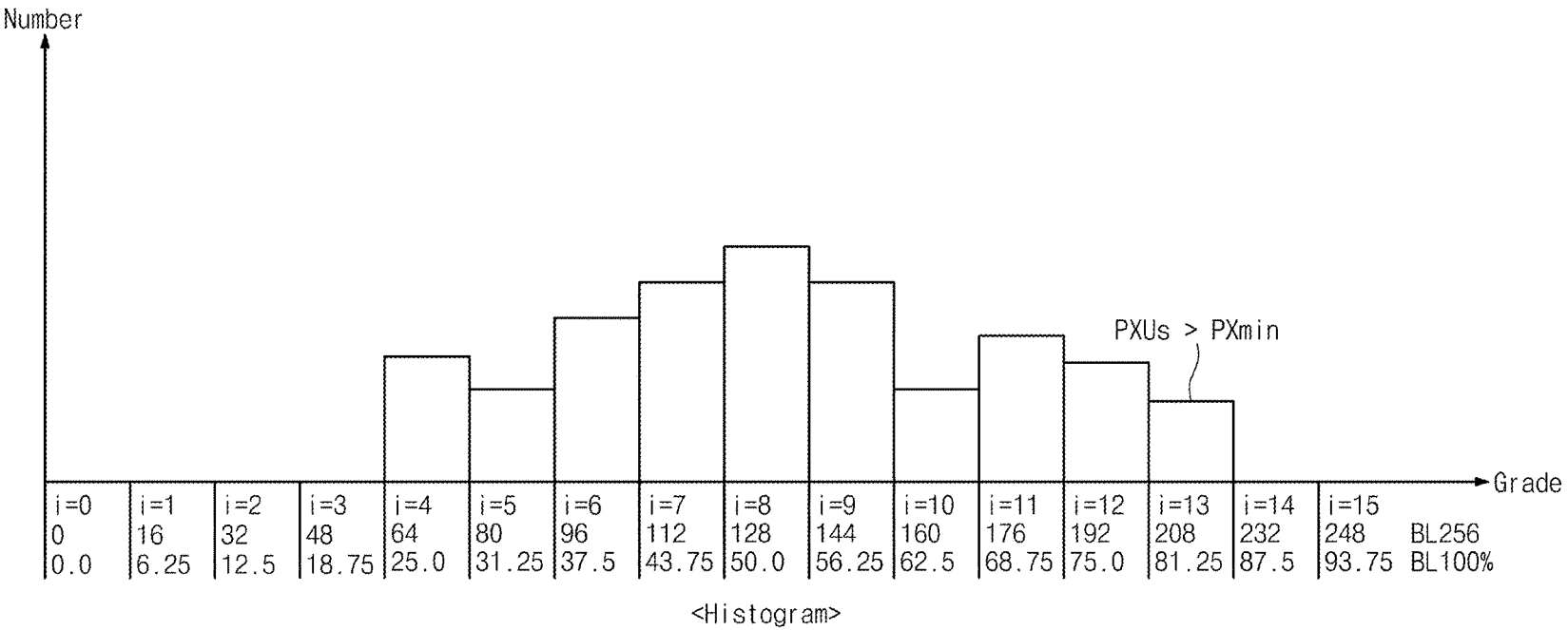
Figure 12:
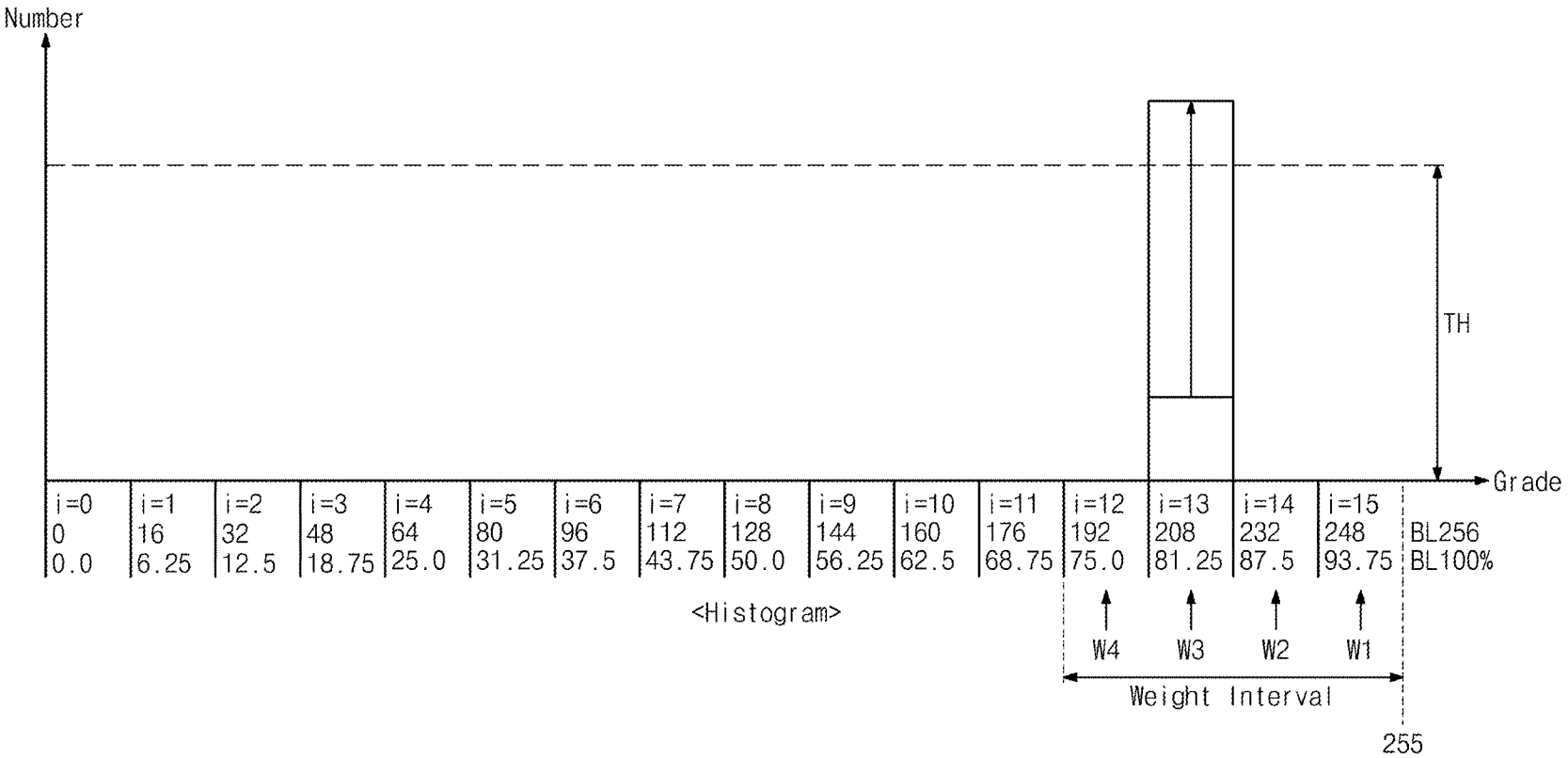

Referring to FIGS. 11 and 12, since the values of the fifteenth grade bin (i=15) and the fourteenth grade bin (i=14) are 0, values obtained by multiplying the values of the fifteenth grade bin (i=15) and the fourteenth grade bin (i=14) by the first and second weights W1 and W2 are 0. Accordingly, there are no values accumulated to the fifteenth grade bin (i=15) and the fourteenth grade bin (i=14). The number of pixel units corresponding to the value of the thirteenth grade bin (i=13) is greater than the minimum number of view pixels PXmin. The value obtained by multiplying the value of the thirteenth grade bin (i=13) by the third weight W3 may be greater than the threshold value TH. The luminance level determining unit 1523 determines the luminance level by using the luminance level corresponding to the value of the thirteenth bin (i=13), which is greater than the threshold value TH. Accordingly, since the color gamut is set to a region corresponding to the thirteenth grade bin (i=13), an image corresponding to the thirteenth grade bin (i=13) may be normally displayed. Consequently, the display apparatus 100 according to an embodiment of the present disclosure may improve the display quality.

Figure 13:
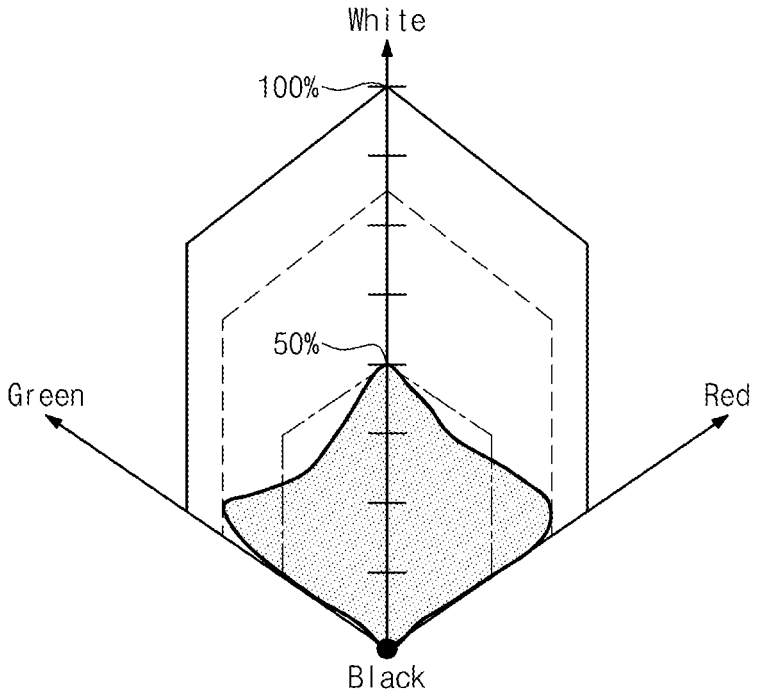
FIG. 13 is a view illustrating a color gamut based on a luminance level determined by the luminance level determining unit.

FIG. 13 is a view illustrating a color gamut based on a luminance level determined by the luminance level determining unit. For the convenience of explanation, the color gamut illustrated in FIG. 13 is illustrated as a red, green, and white color gamut. A color gamut distribution of image signals is illustrated with a gray color. A color disposed in an outermost region in the color gamut distribution of the image signals is assumed to be a color that is displayed with a number of pixel units PXU that is greater than the minimum number of view pixels PXmin. When the bin weight is not applied, the luminance level may be set to 50% represented with a dashed and dotted line. In other words, when a maximum luminance of the backlight is assumed to be 100%, light generated by the backlight 170 has a luminance level of 50%. In this case, images out of the color gamut range corresponding to the luminance level of 50% may not be normally displayed. However, the display apparatus 100 of an embodiment of the present disclosure extends the luminance level from the region represented with the dashed and dotted line to a region represented with a dotted line. Accordingly, in an embodiment of the present disclosure, the color gamut is extended from the dashed and dotted line region to the dotted line region. As a result, an image can be normally displayed.

Figure 14:
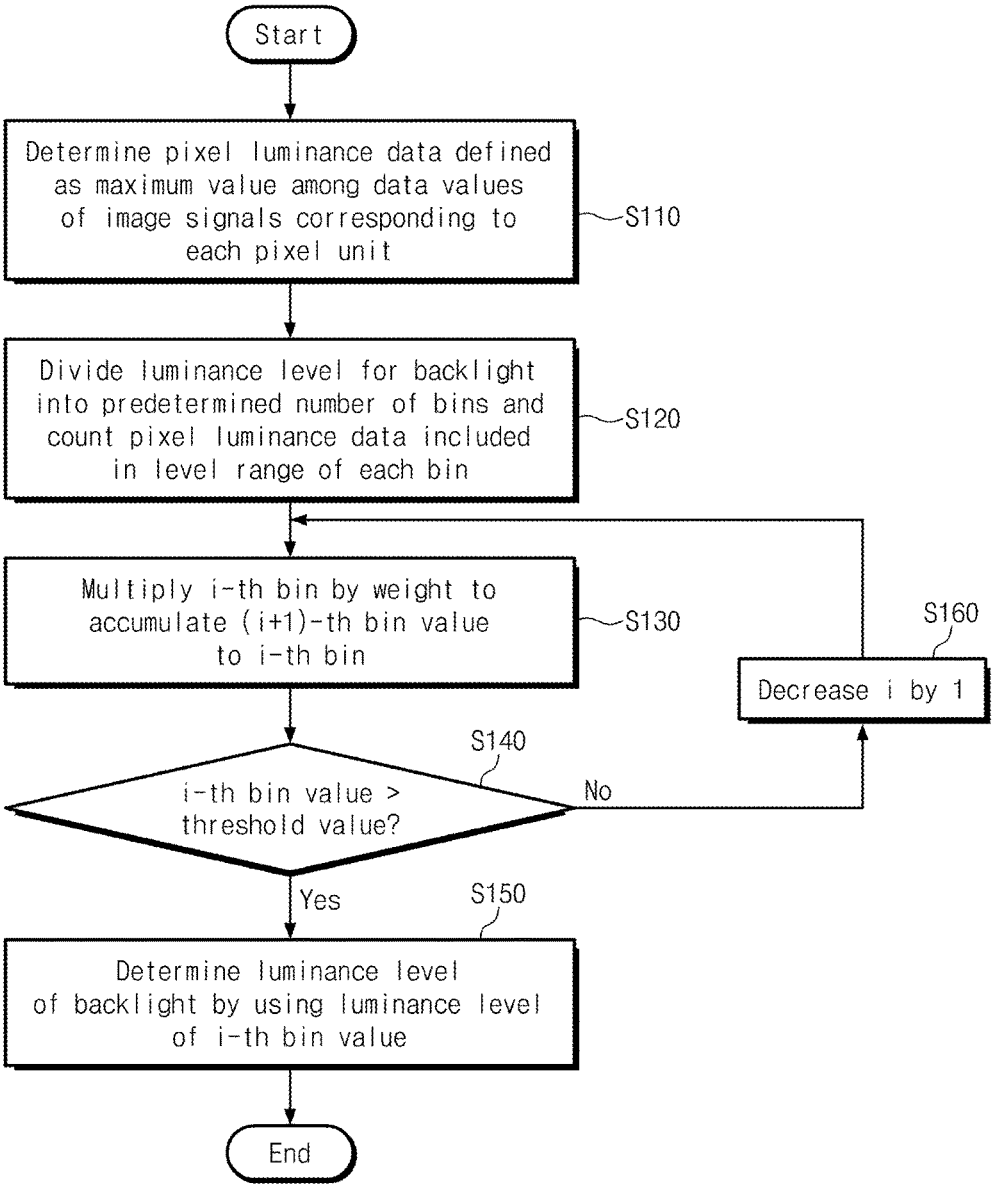
FIG. 14 is a flow chart for explaining a driving method of a display apparatus according to an embodiment of the present disclosure.

FIG. 14 is a flow chart for explaining a driving method of a display apparatus according to an embodiment of the present disclosure. The image signals Rm, Gm, Bm, and Wm generated by the color gamut mapping unit 1512 is provided to the backlight luminance controller 152, and then the red, green, blue, and white data Rw, Gw, Bw, and Ww that are multiplied by the red weight RWT, the green weight GWT, the blue weight BWT, and the white weight WWT are generated. In operation S110, the pixel luminance data PLD defined as the maximum value among the data values of the image signals Rm, Gm, Bm, and Wm corresponding to each pixel unit PXU is determined. In operation S120, the luminance level for the backlight 170 is divided into a predetermined number of bins (i), and the number of the pixel luminance data PLD included in a level range of each bin (i) is counted.

In operation S130, when the i-th bin corresponds to the bin weight interval, the i-th bin is multiplied by the bin weight and the value of the (i+1)-th bin is accumulated to the i-th bin. In operation S140, it is checked whether the value of the i-th bin is greater than the threshold value TH.

When the value of the i-th bin is greater than the threshold value TH, the luminance level of the backlight 170 is determined by using the luminance level of the value of the i-th bin in operation S150. When the value of the i-th bin is equal to or smaller than the threshold value TH, i is decreased by 1 and operation S130 is performed. Due to these operations, the image signals adjacent to the saturation region are normally displayed. Consequently, the driving method of a display apparatus according to an embodiment of the present disclosure improves a display quality.

The above-disclosed subject matter is to be considered illustrative and not restrictive, and the appended claims are intended to cover modifications, enhancements, and other embodiments, which may fall within the spirit and scope of the present disclosure. Thus, to the extent allowed by law, the scope of the present disclosure is to be determined by the broadest permissible interpretation of the following claims and their equivalents, and shall not be restricted or limited by the foregoing detailed description.

What is claimed is:

1. A display apparatus comprising:

a display panel in which a plurality of pixel units are disposed;

a backlight providing light to the display panel;

a data processor mapping image signals to a color gamut of the display apparatus and providing mapped image signals; and a backlight luminance controller setting a luminance level of the backlight to a value corresponding to a color gamut boundary of the image signals adjacent to a saturation region by using the mapped image signals, wherein the backlight luminance controller includes:

a histogram analyzer receiving pixel luminance data defined as a maximum value among data values of color mapped image signals corresponding to each of the pixel units among the color mapped image signals, dividing the luminance level of the backlight into a predetermined number of bins, and counting a number of pixel luminance data in a level range of each of the bins; and a luminance level determiner, when an i-th bin corresponds to a bin weight interval defined as an interval from a maximum bin to a bin comprising a predetermined luminance level value, multiplying a value of the (i+1)-th bin by a bin weight corresponding to the (i+1)-th bin and accumulating a value of an (i+1)-th bin to the i-th bin, and wherein the each of the bins having a luminance level value greater than the predetermined luminance level value has a different bin weight value.

2. The display apparatus of claim 1, wherein the data processor converts the image signals comprising red, green, and blue image signals into the color mapped image signals comprising red, green, blue, and white image signals.

3. The display apparatus of claim 2, wherein each of the plurality of pixel units comprises:

a first pixel group comprising two of red, green, blue, and white pixels; and a second pixel group comprising remaining two of the red, green, blue, and white pixels.

4. The display device of claim 1, wherein the data processor comprises:

an input gamma circuit receiving the image signals and providing linearized the image signals;

a color gamut mapper mapping the linearized image signals to the color gamut of the display apparatus and providing the color mapped image signals;

a clamper converting the color mapped image signals received from the color gamut mapper to clamped image signals corresponding to the luminance level determined by the backlight luminance controller within a color gamut range corresponding to the luminance level;

a sub pixel rendering circuit receiving the clamped image signals from the clamper and providing rendered image signals corresponding to pixels of the pixel units; and an output gamma circuit receiving the rendered image signals and performing reverse gamma correction.

5. The display device of claim 3, wherein the luminance level determiner, when the value of the i-th bin is greater than a threshold value, determining the luminance level of the backlight by using a luminance level corresponding to the value of the i-th bin.

6. The display apparatus of claim 5, wherein the luminance level determiner decreases an index i by 1 to move to a lower bin when the value of the i-th bin is not greater than the threshold value.

7. The display apparatus of claim 5, wherein when the pixel luminance data is 8-bit data, and the predetermined luminance level is set to a luminance level of 200.

8. The display device of claim 5, wherein the backlight luminance controller further comprises:

a color weight part multiplying the color mapped image signals mapped by the color mapper by weights, respectively, and determining the pixel luminance data among the color mapped image signals multiplied by the weights to provide the determined pixel luminance data to the luminance level determiner; and a smoothing circuit correcting the luminance level determined by the luminance level determiner with a median value of luminance values of a previous frame and a current frame and outputting the median value.

9. The display apparatus of claim 1, wherein a value of the bin weight is greater than 1.

10. The display apparatus of claim 9, wherein the value of the bin weight becomes smaller as the index i is moved from the maximum bin to a minimum bin in the bin weigh interval.

11. The display apparatus of claim 10, wherein a maximum bin weight multiplied by the maximum bin is set so that a value obtained by multiplying a number of minimum view pixels defined as a minimum number of pixel units by the maximum bin weight is greater than the threshold value.

12. A driving method of a display apparatus, the driving method comprising:

mapping image signals and providing mapped image signals to pixel units of a display panel of the display apparatus to a color gamut of the display apparatus;

setting a luminance level of a backlight to a value corresponding to image signals adjacent to a saturation region by using the mapped image signals; and generating light corresponding to the luminance level to provide the light to the pixel units, wherein the setting of a luminance level of a backlight comprises:

receiving pixel luminance data defined as a maximum value among data values of color mapped image signals corresponding to each of the pixel units in the mapped image signals;

dividing the luminance level of the backlight into a predetermined number of bins and counting a number of pixel luminance data in a level range of each of the bins;

when an i-th bin corresponds to a bin weight interval defined as an interval from a maximum bin to a bin comprising a predetermined luminance level value, multiplying a value of the i-th bin by a bin weight and accumulating a value of an (i+1)-th bin to the i-th bin, and wherein the each of the bins having a luminance level value greater than the predetermined luminance level value has a different bin weight value.

13. The driving method of claim 12, wherein the image signals comprise red, green, and blue image signals and the mapped image signals comprise red, green, blue, and white image signals, the each of the pixel units comprises a first pixel group comprising two of red, green, blue, and white pixels; and a second pixel group comprising remaining two of the red, green, blue, and white pixels.

14. The driving method of claim 12, wherein the mapping comprises:

receiving the image signals and providing linearized the image signals;

mapping the linearized image signals to a color gamut of the display apparatus and providing color mapped image signals;

converting the color mapped image signals and providing clamped image signals corresponding to the luminance level of the backlight within a color gamut range corresponding to the luminance level;

receiving the clamped image signals and providing rendered image signals corresponding to pixels of the pixel units; and receiving the rendered image signals to perform reverse gamma correction.

15. The driving method of claim 12, wherein when the value of the i-th bin is greater than a threshold value, determining the luminance level of the backlight by using a luminance level corresponding to the value of the i-th bin; and when the value of the i-th bin is not greater than the threshold value, decreasing an index i by 1 to proceed to an operation of multiplying the value of the i-th bin by the bin weight.

16. The driving method of claim 15, wherein the value of the bin weight is greater than 1 and becomes smaller as the index i is moved from the maximum bin to a minimum bin in the bin weigh interval.

17. The driving method of claim 15, wherein a maximum bin weight multiplied by the maximum bin is set so that a value obtained by multiplying a number of minimum view pixels defined as a minimum number of pixel units by the maximum bin weight is greater than the threshold value.

18. The driving method of claim 15, wherein when the pixel luminance data is 8-bit data, the predetermined luminance level is set to a luminance level of 200.

19. The driving method of claim 15, wherein the backlight luminance controller further comprises:

multiplying the color mapped image signals by weights and determining the pixel luminance data among the color mapped image signals multiplied by the weights; and correcting the determined luminance level with a median value of luminance values of a previous frame and a current frame and outputting the corrected luminance value.

* * * * *